US011946191B2

(12) United States Patent
Leibman et al.

(10) Patent No.: US 11,946,191 B2
(45) Date of Patent: Apr. 2, 2024

(54) WASHING MACHINE APPLIANCE AND ADDITIVE ASSEMBLY

(71) Applicant: Haier US Appliance Solutions, Inc., Wilmington, DE (US)

(72) Inventors: Alexander B. Leibman, Prospect, KY (US); Venkata Chakradhar Rangu, Louisville, KY (US); Jay Pareshbhai Shinde, Hyderabad (IN); FikreAdam Abebe Damtew, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 128 days.

(21) Appl. No.: 17/576,124

(22) Filed: Jan. 14, 2022

(65) Prior Publication Data

US 2023/0228027 A1 Jul. 20, 2023

(51) Int. Cl.
*D06F 39/08* (2006.01)
*D06F 39/02* (2006.01)

(52) U.S. Cl.
CPC ..... *D06F 39/088* (2013.01); *D06F 39/022* (2013.01)

(58) Field of Classification Search
None
See application file for complete search history.

(56) References Cited

U.S. PATENT DOCUMENTS 3,066,520 A 12/1962 Jennings
3,188,146 A 6/1965 Cordes
6,363,562 B1 4/2002 Bruntz
2005/0265890 A1 12/2005 Yang
2013/0192084 A1 8/2013 Hill
2020/0131687 A1* 4/2020 Wright ..... D06F 39/022

FOREIGN PATENT DOCUMENTS

CN 208266481 U 12/2018
EP 391087 A1 10/1990
JP 2007313141 A 12/2007
JP 2008073127 A 4/2008
KR 100765278 B1 10/2007

OTHER PUBLICATIONS

Washer With Aroma Sprayer, Clarivate Analytics translation KR 100765278 (Year: 2007).*

* cited by examiner

*Primary Examiner* — Cristi J Tate-Sims
(74) *Attorney, Agent, or Firm* — Dority & Manning, P.A.

(57) ABSTRACT

A washing machine appliance may include a cabinet, a tub, a wash basket, a drawer, an air inlet, and an air outlet. The cabinet defining an opening to receive articles therethrough. The tub being positioned within the cabinet. The wash basket being rotatably mounted within the tub. The wash basket defining a wash chamber for receiving articles for washing. The drawer mounted to the cabinet. The drawer defining a compartment to receive a scent additive therein. The air inlet line extending from the compartment in downstream fluid communication with the wash chamber to direct air therefrom. The air outlet line extending to the compartment in upstream fluid communication with the wash chamber to direct air thereto.

20 Claims, 9 Drawing Sheets

WASHING MACHINE APPLIANCE AND ADDITIVE ASSEMBLY

FIELD OF THE INVENTION

The present subject matter relates generally to washing machine appliances and more particularly to additive assemblies for washing machine appliances.

BACKGROUND OF THE INVENTION

Washing machine appliances generally include a tub for containing water or wash liquid, e.g., water and detergent, bleach, or other wash additives. A basket is rotatably mounted within the tub and defines a wash chamber for receipt of articles for washing. During normal operation of such washing machine appliances, the wash liquid is directed into the tub and onto articles within the wash chamber of the basket. The basket or an agitation element can rotate at various speeds to agitate articles within the wash chamber, to wring wash fluid from articles within the wash chamber, etc.

In some instances, it may be desirable to provide certain objects or fluids for the aiding or enhancing the wash of articles within a washing machine appliance. For instance, some users may desire additional scent modification of washed articles (e.g., beyond what is provided by traditional detergents or fabric softeners). To this end, some users may add concentrated scent pellets or oils to the basket for each new wash load. Such pellets often dissolve with water within the wash basket.

Difficulties and shortcomings exist with these existing approaches. For instance, a user is required to remember to supply pellets with each wash load. It may be difficult to know the correct or effective quantity of pellets to add for a given load. However, providing a separate measuring and dispensing assembly may increase cost and complexity of the system. Additionally, performance of the scent pellets may be compromised or hindered by the one or more rinse cycles of a single washing operation, which can, in effect, wash away the scent pellets within the basket and dilute the effects thereof.

Accordingly, a washing machine appliance having an additive assembly for delivering certain additives affecting the smell or performance of fabrics would be desirable. More particularly, an additive dispensing assembly that provides a suitable additive over multiple loads (e.g., without requiring multiple moving parts or without diluting the additive through a rinse cycle) would be especially desirable.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a washing machine appliance is provided. The washing machine appliance may include a cabinet, a tub, a wash basket, a drawer, an air inlet, and an air outlet. The cabinet defining an opening to receive articles therethrough. The tub being positioned within the cabinet. The wash basket being rotatably mounted within the tub. The wash basket defining a wash chamber for receiving articles for washing. The drawer mounted to the cabinet. The drawer defining a compartment to receive a scent additive therein. The air inlet line extending from the compartment in downstream fluid communication with the wash chamber to direct air therefrom. The air outlet line extending to the compartment in upstream fluid communication with the wash chamber to direct air thereto.

In another exemplary aspect of the present disclosure, a washing machine appliance is provided. The washing machine appliance may include a cabinet, a tub, a wash basket, a drawer, an air inlet, and an air outlet. The cabinet may include a front panel. The front panel may define an opening to receive articles therethrough. The tub may be positioned within the cabinet. The wash basket may be rotatably mounted within the tub. The wash basket may define a wash chamber for receiving articles for washing. The drawer may be movably mounted to the cabinet. The drawer may define a first compartment to receive a scent additive therein and a liquid compartment to receive a liquid additive therein. The liquid compartment may be horizontally spaced apart from the first compartment. The air inlet line may extend from the first compartment in upstream fluid communication with the wash chamber to direct air thereto. The air outlet line may extend to the first compartment in downstream fluid communication with the wash chamber to direct air therefrom.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
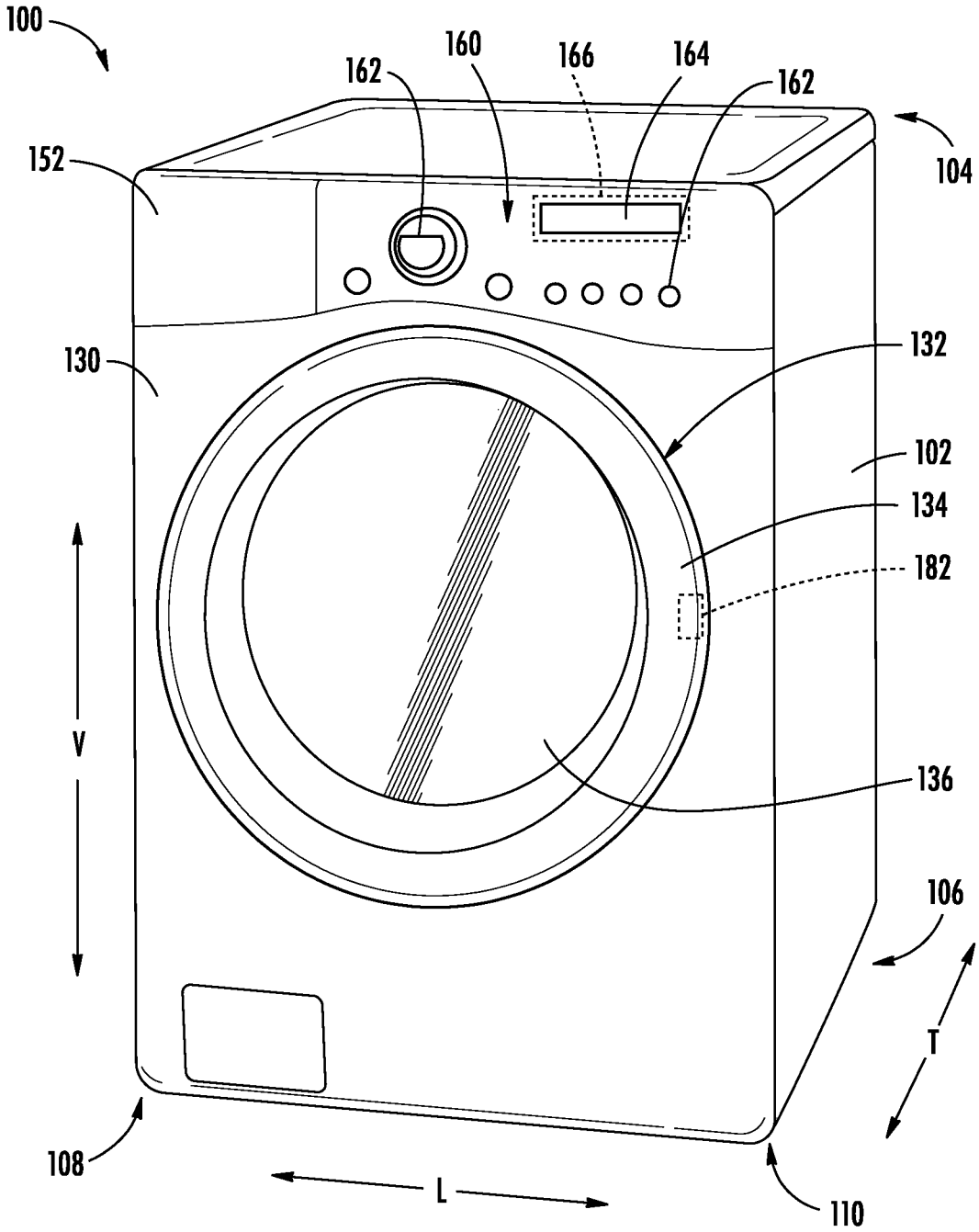
FIG. 1 provides a perspective view of a washing machine appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
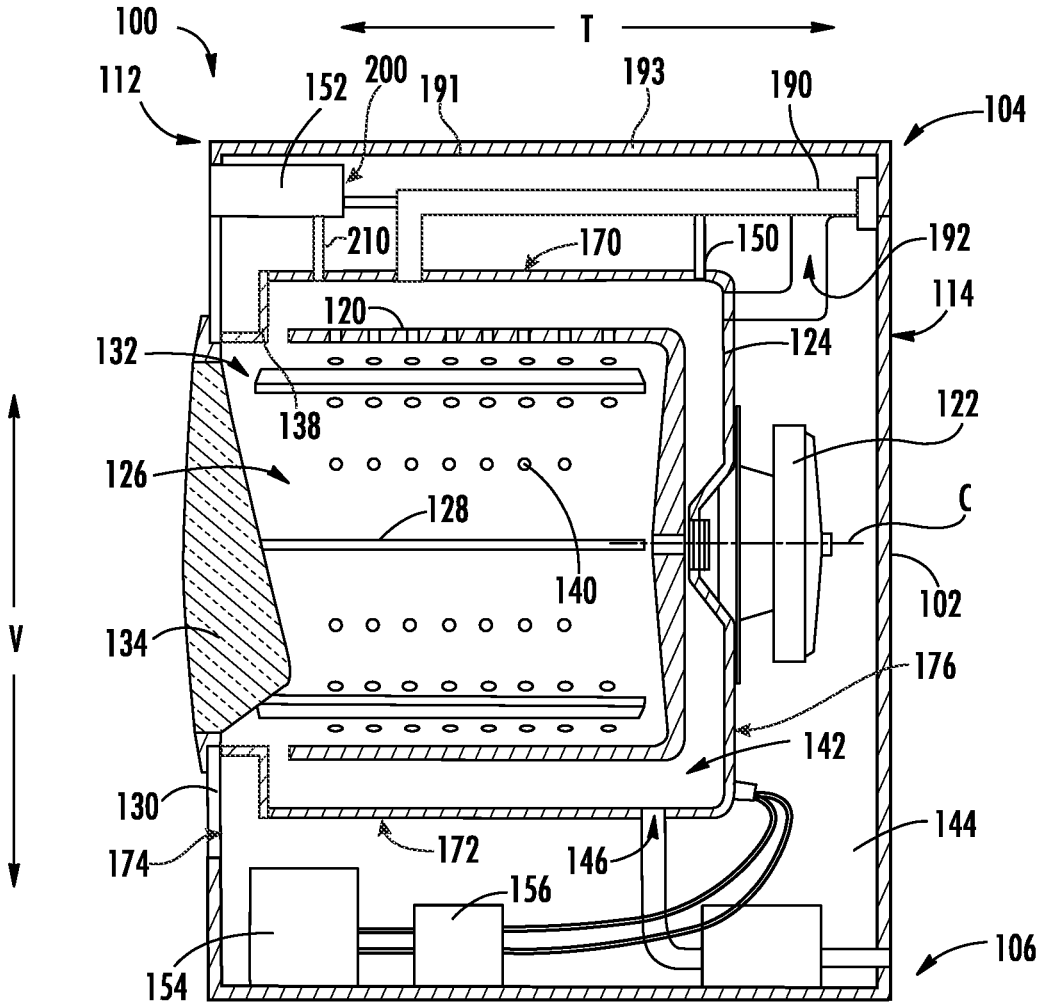
FIG. 2 provides a cross-sectional, side, elevation view of a washing machine appliance according to exemplary embodiments of the present disclosure.
Figure 3:
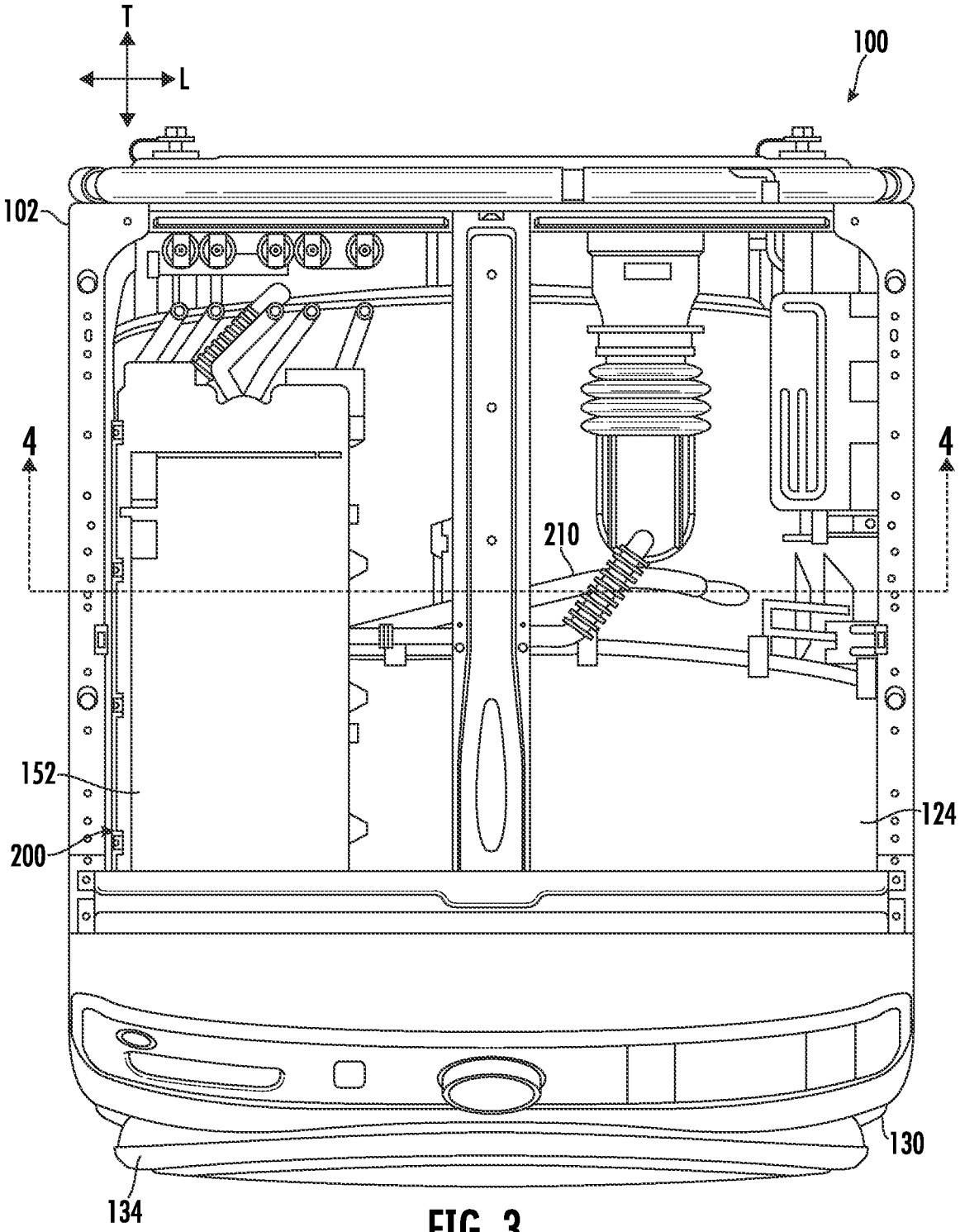
FIG. 3 provides a top plan view of the exemplary washing machine appliance of FIG. 2, wherein a top panel has been removed for clarity.
Figure 4:
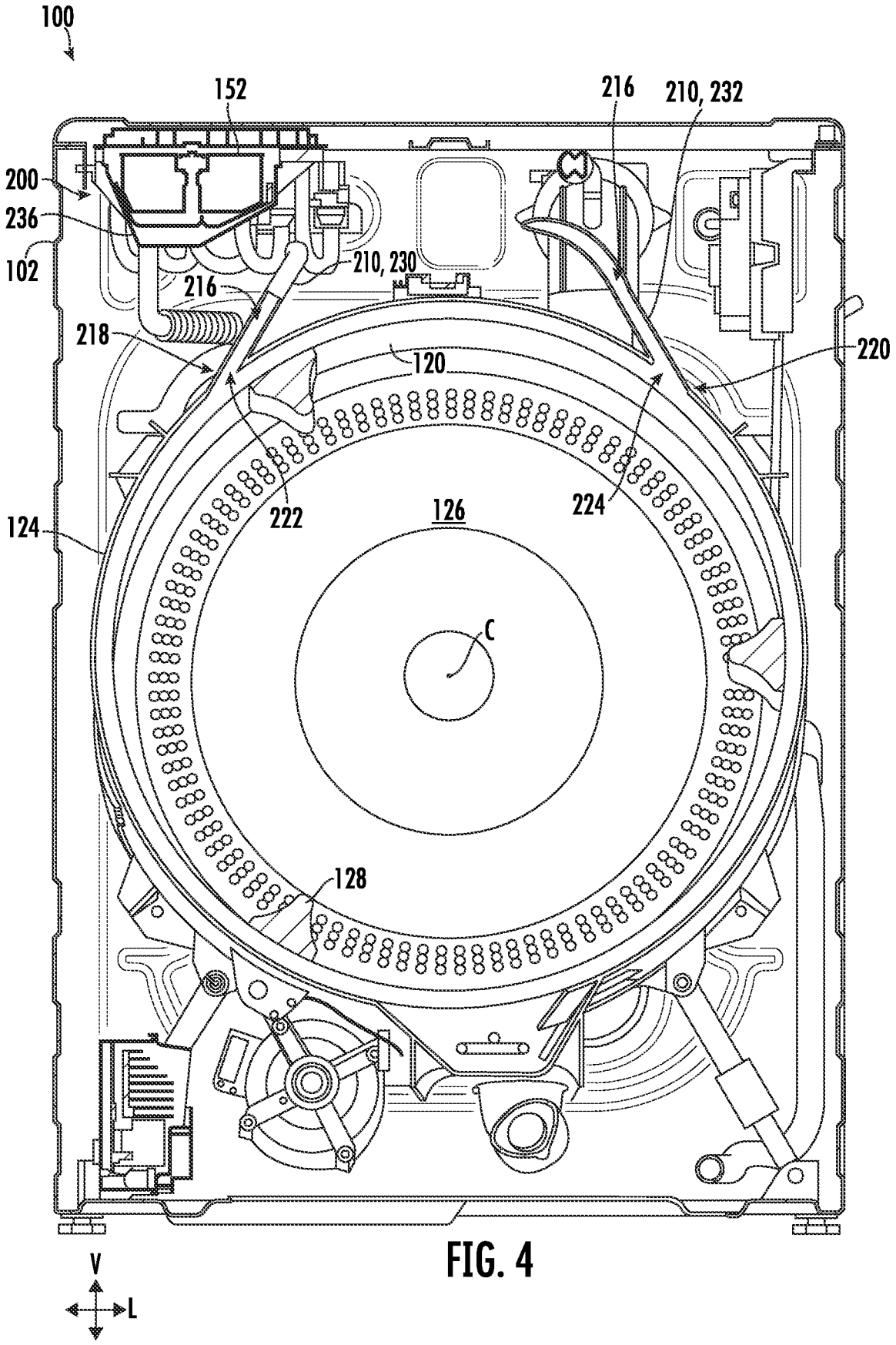
FIG. 4 provides a section view of the exemplary washing machine appliance of FIG. 3, taken along the lines 4-4.
Figure 5B:
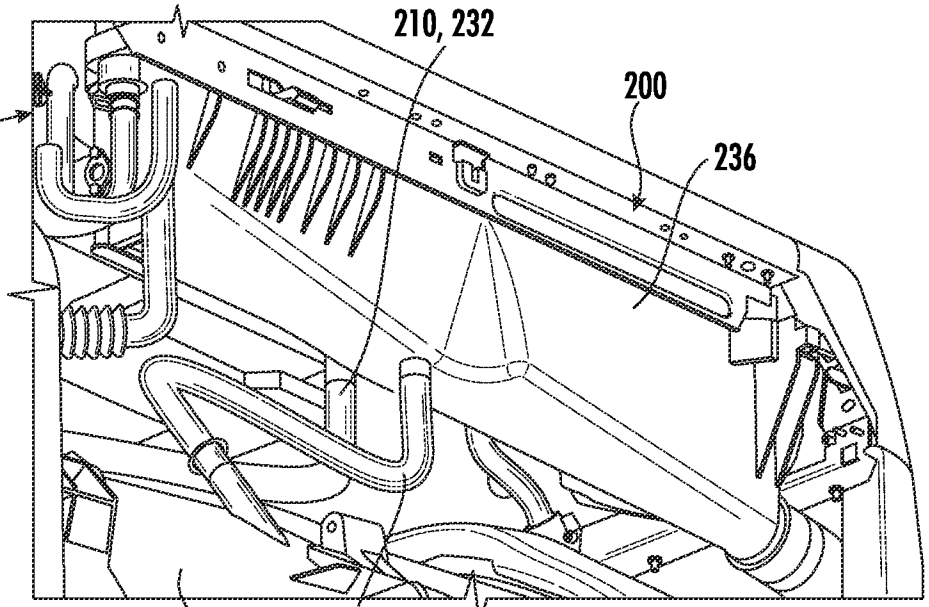
FIG. 5B provides a magnified perspective view of a portion of the exemplary washing machine appliance, as shown in FIG. 5A.
Figure 5A:
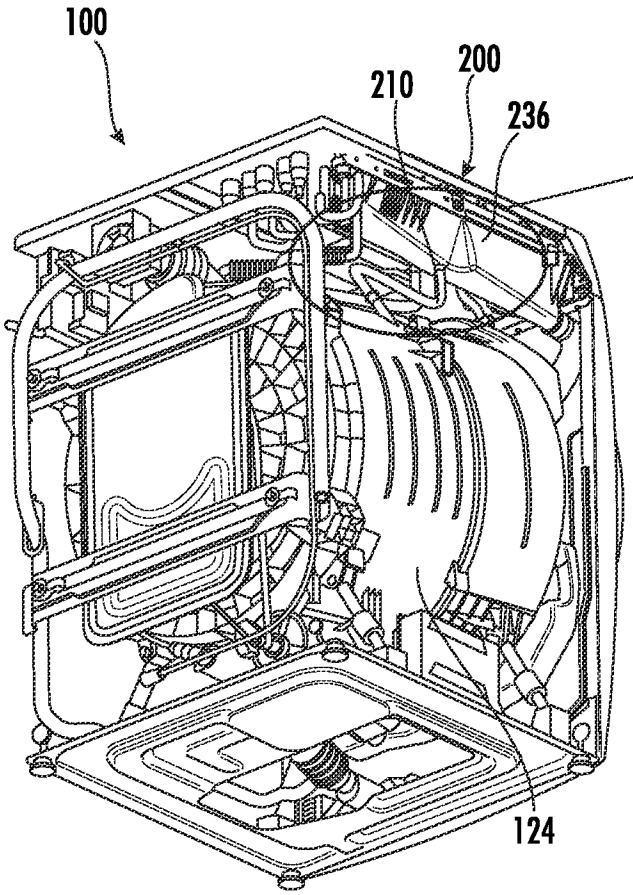
FIG. 5A provides a rear perspective view of the exemplary washing machine appliance of FIG. 2, wherein a portion of the cabinet has been removed for clarity.
Figure 6:
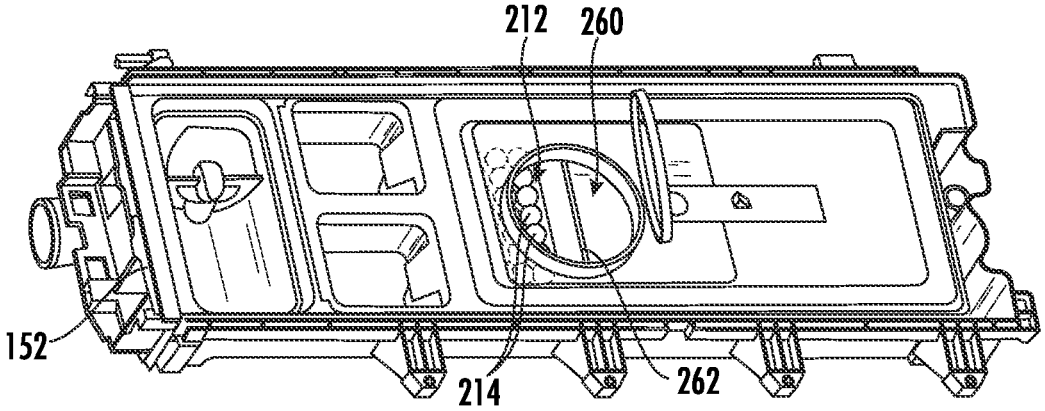
FIG. 6 provides a perspective view of an additive drawer, in isolation, of an exemplary washing machine appliance, according to exemplary embodiments of the present disclosure.
Figure 7:
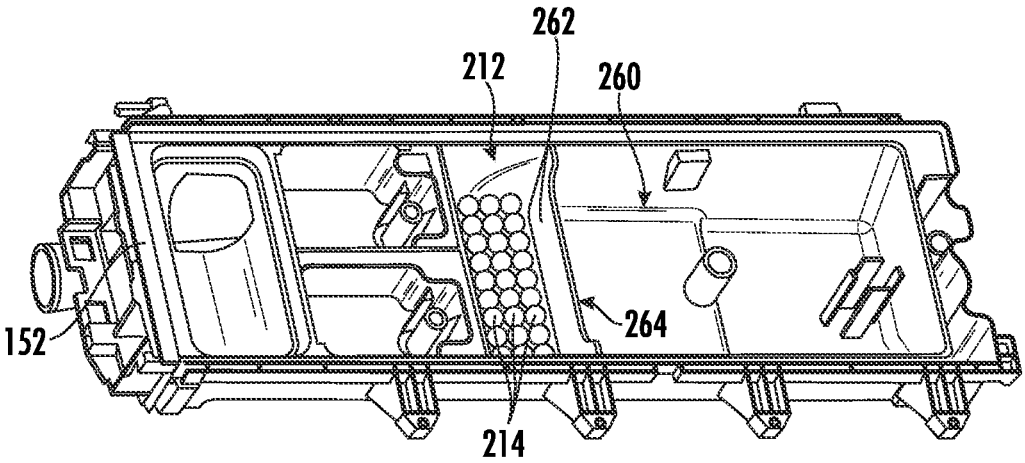
FIG. 7 provides a perspective view of the exemplary additive drawer of FIG. 6, wherein a cover has been removed for clarity.
Figure 8:
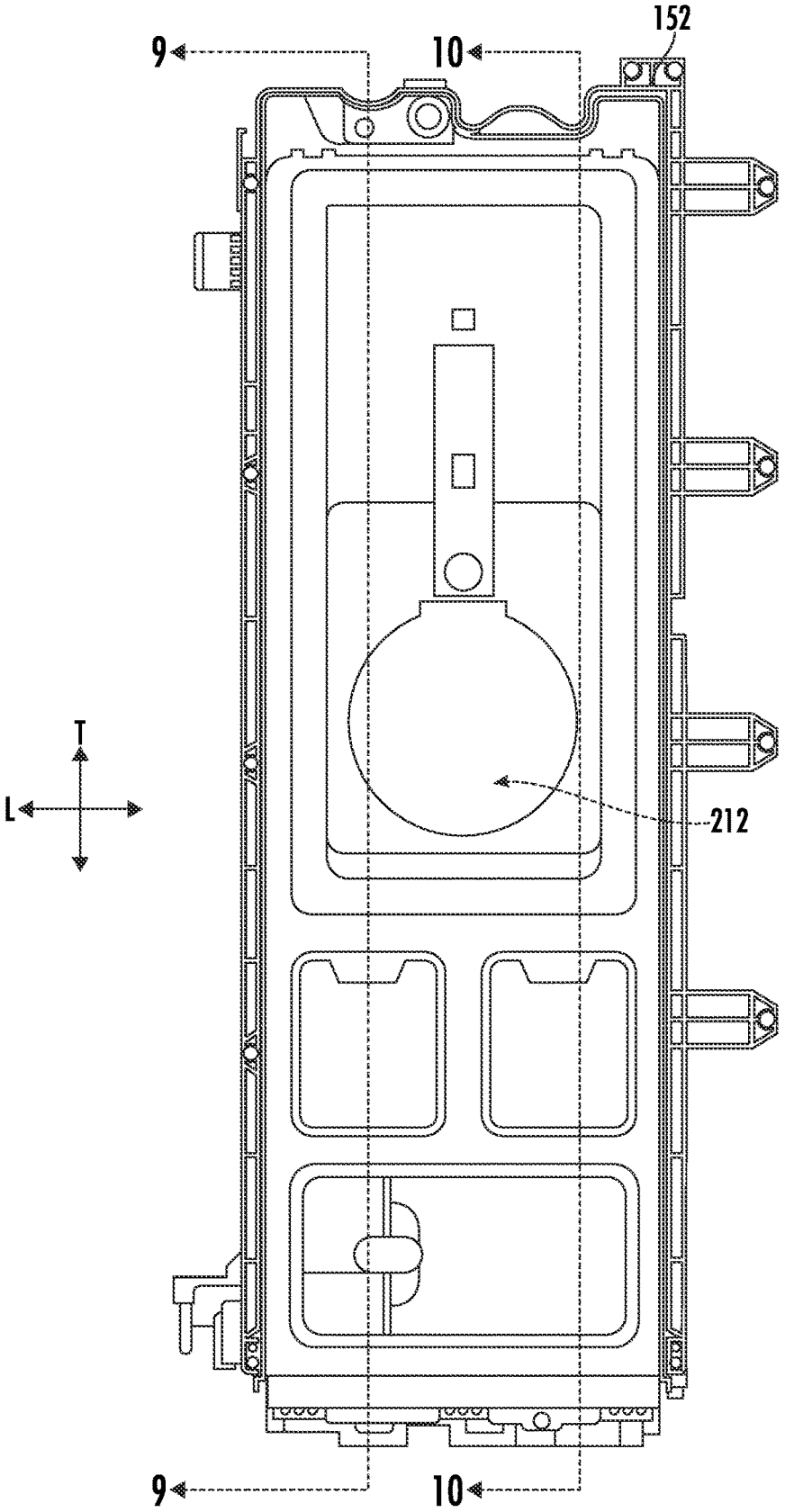
FIG. 8 provides a top plan view of the exemplary additive drawer of FIG. 6.
Figure 9:
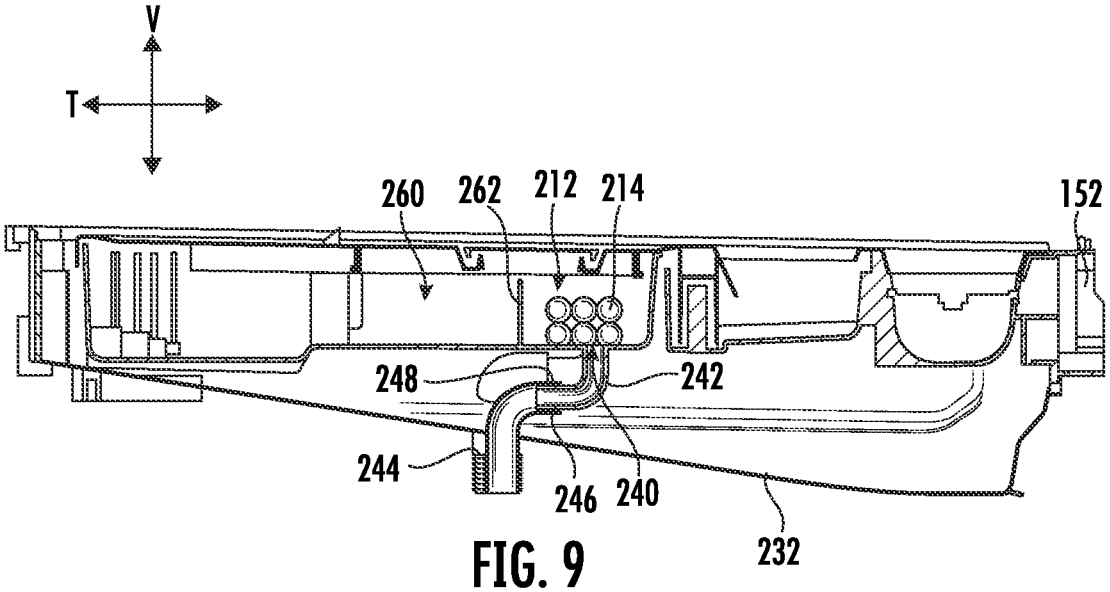
FIG. 9 provides a provides a section view of the exemplary additive drawer of FIG. 8, taken along the lines 9-9.
Figure 10:
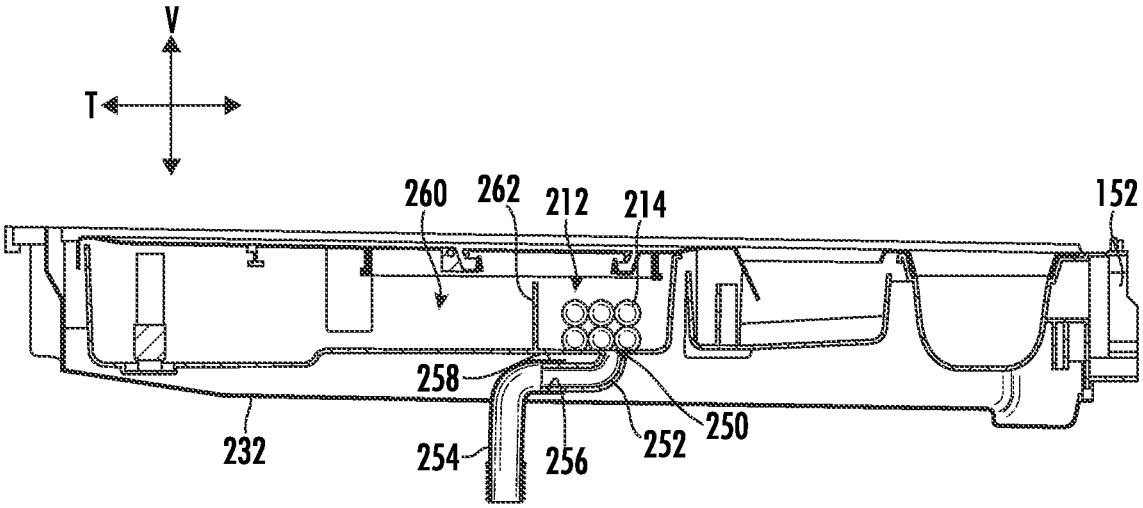
FIG. 10 provides a provides a section view of the exemplary additive drawer of FIG. 8, taken along the lines 10-10.

Referring now to the figures, FIG. 1 is a perspective view of an exemplary horizontal axis washing machine appliance 100, and FIG. 2 is a cross-sectional, side, elevation view of washing machine appliance 100. As illustrated, washing machine appliance 100 generally defines a vertical direction V, a lateral direction L, and a transverse direction T, each of which is mutually perpendicular, such that an orthogonal coordinate system is defined. Washing machine appliance 100 includes a cabinet 102 that extends between a top 104 and a bottom 106 along the vertical direction V, between a left side 108 and a right side 110 along the lateral direction L, and between a front 112 and a rear 114 along the transverse direction T.

Referring to FIG. 2, a wash tub 124 is positioned within cabinet 102 and is generally configured for retaining wash fluids during an operating cycle. As used herein, "wash fluid" may refer to water, detergent, fabric softener, bleach, or any other suitable wash additive or combination thereof. Wash tub 124 is substantially fixed relative to cabinet 102 such that it does not rotate or translate relative to cabinet 102.

A wash basket 120 is received within wash tub 124 and defines a wash chamber 126 that is configured for receipt of articles for washing. More specifically, wash basket 120 is rotatably mounted within wash tub 124 such that it is rotatable about an axis of rotation A. According to the illustrated embodiments, the axis of rotation A is substantially parallel to the transverse direction T. In this regard, washing machine appliance 100 is generally referred to as a "horizontal axis" or "front load" washing machine appliance 100.

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Washing machine appliance 100 includes a motor assembly 122 that is in mechanical communication with wash basket 120 to selectively rotate wash basket 120 (e.g., during an agitation or a rinse cycle of washing machine appliance 100). According to the illustrated embodiments, motor assembly 122 is a pancake motor. However, it should be appreciated that any suitable type, size, or configuration of motor may be used to rotate wash basket 120 according to alternative embodiments.

Referring generally to FIGS. 1 and 2, cabinet 102 also includes a front panel 130 that defines an opening 132 that permits user access to wash basket 120 of wash tub 124. More specifically, washing machine appliance 100 includes a door 134 that is positioned over opening 132 and is rotatably mounted to front panel 130 (e.g., about a door axis that is substantially parallel to the vertical direction V). In this manner, door 134 permits selective access to opening 132 by being movable between an open position (not shown) facilitating access to a wash tub 124 and a closed position (FIG. 1) prohibiting access to wash tub 124. Optionally, a lock assembly 182 may be fixed to cabinet 102 to selectively lock or hold a free end of the door 134 to cabinet 102 when door 134 is in the closed position (e.g., during certain operations or wash cycles).

In some embodiments, a window 136 in door 134 permits viewing of wash basket 120 when door 134 is in the closed position (e.g., during operation of washing machine appliance 100). Door 134 also includes a handle (not shown) that, for example, a user may pull when opening and closing door 134. Further, although door 134 is illustrated as mounted to front panel 130, it should be appreciated that door 134 may be mounted to another side of cabinet 102 or any other suitable support according to alternative embodiments.

A resilient front gasket or baffle 138 may extend between tub 124 and the front panel 130 about the opening 132 covered by door 134, further sealing tub 124 from cabinet 102. Thus, resilient baffle 138 may extend from the front opening 132 to tub 124. Moreover, when door 134 is in the closed position, baffle 138 may contact the door 134 in sealing engagement therewith.

As shown, wash basket 120 defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of, and generally collects, wash fluid during operation of washing machine appliance 100. For example, during operation of washing machine appliance 100, wash fluid may be urged (e.g., by gravity) from basket 120 to sump 142 through plurality of perforations 140. A pump assembly 144 is located beneath wash tub 124 for gravity assisted flow when draining wash tub 124 (e.g., via a drain 146). Pump assembly 144 may also be configured for recirculating wash fluid within wash tub 124.

In some embodiments, washing machine appliance 100 includes an additive dispenser or spout 150. For example, spout 150 may be in fluid communication with a water supply (not shown) in order to direct fluid (e.g., clean water) into wash tub 124. Spout 150 may also be in fluid communication with the sump 142. For example, pump assembly 144 may direct wash fluid disposed in sump 142 to spout 150 in order to circulate wash fluid in wash tub 124.

As illustrated, an additive drawer 152 may be slidably mounted within front panel 130. Additive drawer 152 receives a wash additive (e.g., detergent, fabric softener, bleach, scent additives or pellets, or any other suitable additive) and directs the fluid additive to wash chamber 126 during certain operations or wash cycle phases of washing machine appliance 100. According to the illustrated embodiment, detergent additive drawer 152 may also be fluidly coupled to spout 150 to facilitate the complete and accurate dispensing of wash additive. As will be described in greater detail below, additive drawer 152 may define a compartment 212 (e.g., infuser compartment separate from one or more compartments for detergent, fabric softener, bleach, etc.) in which one or more scent additives (e.g., scent pellets 214) may be received prior to a washing operation in order to provide the articles being washed with a user-desired scent separate from or in addition to any scent imparted by another wash additive (e.g., detergent, fabric softener, bleach, etc.).

In optional embodiments, a bulk reservoir 154 is disposed within cabinet 102. Bulk reservoir 154 may be configured for receipt of fluid additive for use during operation of washing machine appliance 100. Moreover, bulk reservoir 154 may be sized such that a volume of fluid additive sufficient for a plurality or multitude of wash cycles of washing machine appliance 100 (e.g., five, ten, twenty, fifty, or any other suitable number of wash cycles) may fill bulk reservoir 154. Thus, for example, a user can fill bulk reservoir 154 with fluid additive and operate washing machine appliance 100 for a plurality of wash cycles without refilling bulk reservoir 154 with fluid additive. A reservoir pump 156 is configured for selective delivery of the fluid additive from bulk reservoir 154 to wash tub 124.

In some embodiments, a ventilation line 190 is provided within washing machine appliance 100. In particular, ventilation line 190 may be enclosed within cabinet 102. For instance, as shown in FIG. 2, exemplary embodiments include ventilation line 190 at a position in fluid communication between tub 124 and the surrounding region (e.g., the ambient environment outside of or immediately surrounding cabinet 102, the enclosed volume of cabinet 102 surrounding tub 124, etc.). Generally, it is understood that ventilation line 190 may be provided as any singular or plurality of suitable pipes or conduits (e.g., having non-permeable wall) for directing air therethrough. When assembled, ventilation line 190 defines an air path 192 from tub 124 and within or through cabinet 102 (e.g., to the ambient environment outside of cabinet 102). In optional embodiments, air path 192 extends from the top portion of tub 124 to an upper portion of cabinet 102. However, any other suitable configuration may be provided to facilitate the flow of air from tub 124 and, for example, to the ambient environment (e.g., when washing machine appliance 100 is not in use).

In some embodiments, a control panel 160 including a plurality of input selectors 162 is coupled to front panel 130. Control panel 160 and input selectors 162 may collectively form a user interface input for operator selection of machine cycles and features. For example, in exemplary embodiments, a display 164 indicates selected features, a countdown timer, or other items of interest to machine users.

Operation of washing machine appliance 100 is generally controlled by a controller or processing device 166. In some embodiments, controller 166 is in operative communication with (e.g., electrically or wirelessly connected to) control panel 160 for user manipulation to select washing machine cycles and features. In response to user manipulation of control panel 160, controller 166 operates the various components of washing machine appliance 100 to execute selected machine cycles and features.

Controller 166 may include a memory (e.g., non-transitive memory) and microprocessor, such as a general or special purpose microprocessor operable to execute programming instructions or micro-control code associated with a wash operation. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 160 and other components of washing machine appliance 100, such as motor assembly 122, may be in operative communication with controller 166 via one or more signal lines or shared communication busses. Additionally or alternatively, other features, such as an electronic lock assembly 182 for door 134 may be in operative communication with controller 166 via one or more other signal lines or shared communication busses.

In exemplary embodiments, during operation of washing machine appliance 100, laundry items are loaded into wash basket 120 through opening 132, and a wash cycle is initiated through operator manipulation of input selectors 162. For example, a wash cycle may be initiated such that wash tub 124 is filled with water, detergent, or other fluid additives (e.g., via spout 150 during a fill phase). One or more valves (not shown) can be controlled by washing machine appliance 100 to provide for filling wash basket 120 to the appropriate level for the amount of articles being washed or rinsed. By way of example, once wash basket 120 is properly filled with fluid, the contents of wash basket 120 can be agitated (e.g., with ribs 128) for an agitation phase of laundry items in wash basket 120. During the agitation phase, the basket 120 may be motivated about the axis of rotation A at a set speed (e.g., first speed or tumble speed). As the basket 120 is rotated, articles within the basket 120 may be lifted and permitted to drop therein.

After the agitation phase of the washing operation or wash cycle is completed, wash tub 124 can be drained (e.g., through a drain phase). Laundry articles can then be rinsed (e.g., through a rinse phase) by again adding fluid to wash tub 124, depending on the particulars of the wash cycle selected by a user. Ribs 128 may again provide agitation within wash basket 120. One or more spin phases may also be used. In particular, a spin phase may be applied after the wash cycle or after the rinse cycle in order to wring wash fluid from the articles being washed. During a spin phase, basket 120 is rotated at relatively high speeds. For instance, basket 120 may be rotated at one set speed (e.g., second speed or pre-plaster speed) before being rotated at another set speed (e.g., third speed or plaster speed). As would be understood, the pre-plaster speed may be greater than the tumble speed and the plaster speed may be greater than the pre-plaster speed. Moreover, agitation or tumbling of articles may be reduced as basket 120 increases its rotational velocity such that the plaster speed maintains the articles at a generally fixed position relative to basket 120.

After articles disposed in wash basket 120 are cleaned (or the wash cycle otherwise ends), a user can remove the articles from wash basket 120 (e.g., by opening door 134 and reaching into wash basket 120 through opening 132).

Turning now generally to FIGS. 2 through 11, an additive assembly 200 may be provided for supplying or infusing one or more additives to articles within the wash chamber 126 (e.g., separately from or in addition to detergent from detergent additive drawer 152). As shown, additive assembly 200 may generally include a recirculation line 210 and a compartment 212 that is attached to recirculation line 210. It is understood that recirculation line 210 may be provided as any two or more suitable pipes or conduits (e.g., having non-permeable wall) for directing air therethrough and through at least a portion of compartment 212. As will be described in detail below, one or more additives (e.g., scent pellets 214) may be provided to compartment 212 to treat or affect articles within wash chamber 126 (e.g., as wash basket 120 rotates or spins).

Generally, recirculation line 210 is connected to tub 124 and defines an air path 216 in fluid communication therewith. Specifically, recirculation line 210 includes a discrete air inlet line 230 and air outlet line 232 that, together, extend from a first line end 218 to a second line end 220 (e.g., as connected by compartment 212).

As shown, first line end 218 may be defined by the air inlet line 230 of recirculation line 210. In some embodiments, first line end 218 is disposed on tub 124. For instance, first line end 218 may be mounted on tub 124. An aperture or port 222 defined through a sidewall of tub 124 may be in fluid communication (e.g., downstream fluid communication) with air path 216. Thus, air path 216 may be in fluid communication with tub 124, such as the area wash basket 120 is held within, or wash chamber 126. Moreover, air inlet line 230 may extend through tub 124. Optionally, a collar (e.g., defining or coaxial with the aperture or port 222 defined through the sidewall of tub 124) may be formed with or extend from an outer surface of tub 124 and provide a region or area onto which a conduit of first line end 218 may be affixed.

In some embodiments, first line end 218, and thus at least a portion or all of air inlet line 230, is disposed above (e.g., at a higher height along the vertical direction V than) a centerline C of the tub 124. As shown, the centerline C generally extends along or parallel to the axis of rotation A for wash basket 120. Optionally, the centerline C may be substantially horizontal (e.g., perpendicular or substantially perpendicular to the vertical direction V). Additionally or alternative, centerline C may be centrally located between the top end 170 and the bottom end 172 of tub 124 along the vertical direction V. Thus, the aperture or port 222 through the sidewall of tub 124 may be defined through a portion of tub 124 that is located higher than the centerline C or axis of rotation A for wash basket 120. In some embodiments, first line end 218 is disposed at the top fourth of the tub 124 (i.e., such that about 75% of the vertical height of tub 124 is positioned below second line end 218). In certain embodiments, in addition to the vertical location or height of first line end 218, first line end 218 may be disposed on tub 124 between a front end 174 of tub 124 and a rear end 176 of tub 124. Thus, the aperture or port 222 defined by tub 124 for first line end 218 may be independent of or in addition to the front opening 132 of the tub 124. Notably, water within tub 124 or wash basket 120 may be prevented from entering recirculation line 210 at first line end 218.

As shown, second line end 220 may be defined by the air outlet line 232 of recirculation line 210. In some embodiments, such as that illustrated in FIG. 2, second line second line end 220 is disposed on tub 124 (e.g., apart from first line end). For instance, second line end 220 may be mounted on tub 124. An aperture or port 224 defined through a sidewall of tub 124 may be in fluid communication (e.g., downstream fluid communication) with air path 216. As shown, second line end 220 is spaced apart from first line end 218 (e.g., along the sidewall of tub 124 or along the lateral direction L). Moreover, air outlet line 232 may extend through tub 124. Optionally, a collar (e.g., defining or coaxial with the aperture or port 224 defined through the sidewall of tub 124) may be formed with or extend from an outer surface of tub 124 and provide a region or area onto which a conduit of second line end 220 may be affixed.

Figure 11:
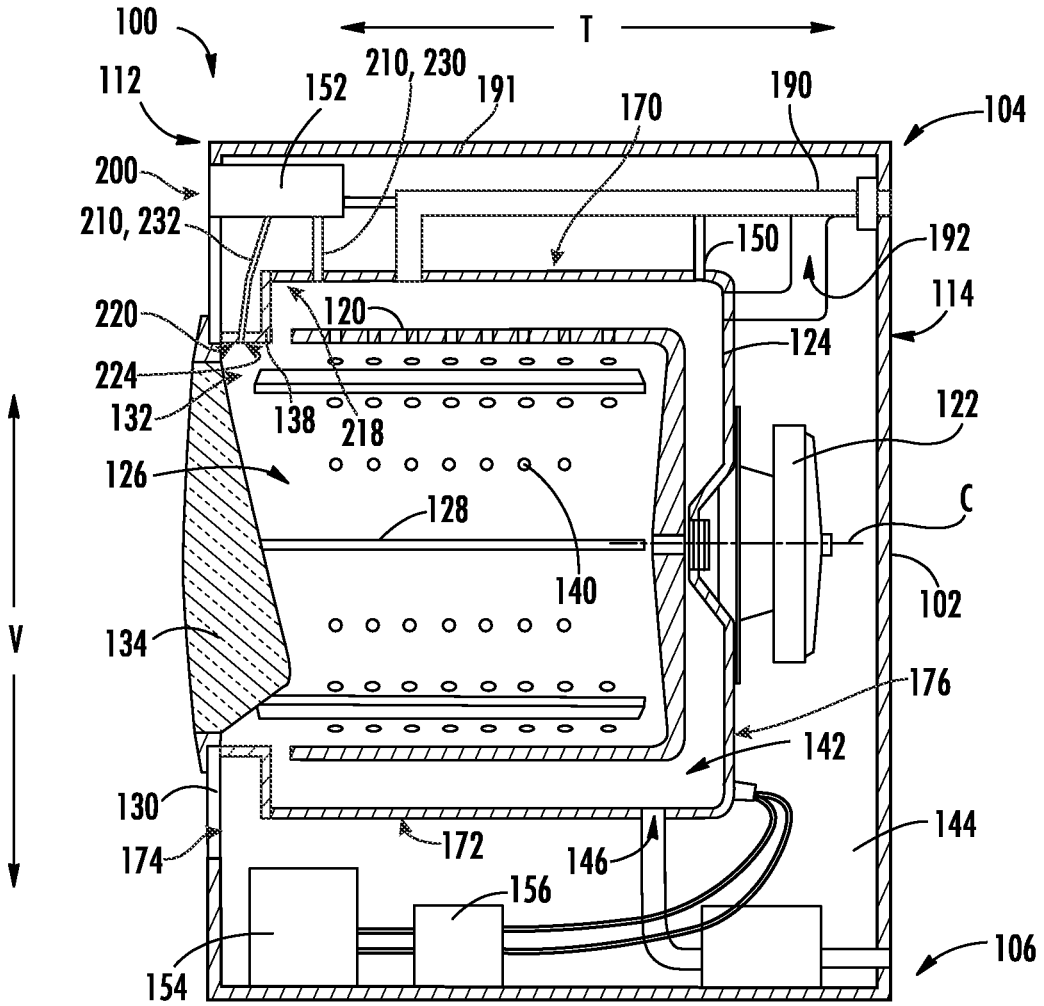
FIG. 11 provides a cross-sectional, side, elevation view of a washing machine appliance according to exemplary embodiments of the present disclosure.

In alternative embodiments, such as that illustrated in FIG. 11, second line end 220 may be mounted on baffle 138 (e.g., forward from first line end 218 relative to opening 132). An aperture or port 224 defined through a sidewall of baffle 138 may be in fluid communication (e.g., downstream fluid communication) with air path 216. Moreover, second line end 220 is spaced apart from first line end 218 (e.g., along the transverse direction T). Moreover, air inlet line 230 may extend through baffle 138. Optionally, a collar (e.g., defining or coaxial with the aperture or port 224 defined through the sidewall of tub 124) may be formed with or extend from an outer surface of baffle 138 and provide a region or area onto which a conduit of second line end 220 may be affixed.

Returning generally to FIGS. 2 through 11, air inlet line 230 and air outlet line 232 may define a recirculation loop in which air flows from tub 124 to recirculation line 210 at first line end 218, and then back to tub 124 from recirculation line 210 at second line end 220. Thus, air may enter recirculation line 210 at a separate location than air returning to tub 124.

In some embodiments, second line end 220 and thus at least a portion or all of air outlet line 232, is disposed above (e.g., at a higher height along the vertical direction V than) a centerline C of the tub 124. Thus, the aperture or port 224 through the sidewall of tub 124 or baffle 138 may be defined through a portion of tub 124 or baffle 138 that is located higher than the centerline C or axis of rotation for wash basket 120. In some embodiments, second line end 220 is disposed at or above the top fourth of the tub 124 (i.e., such that about 75% of the vertical height of tub 124 is positioned below second line end 220). In certain embodiments, in addition to the vertical location or height of second line end 220, second line end 220 may be disposed between a front end 174 of tub 124 and a rear end 176 of tub 124. Thus, the aperture or port 224 for second line end 220 may be independent of or in addition to the front opening 132 of the tub 124. Notably, water within tub 124 or wash basket 120 may be prevented from entering recirculation line 210 at second line end 220. In optional embodiments, the first line end 218 is disposed at a common vertical height with the second line end 220. Thus, although first and second line ends 218, 220 are spaced apart, each may be held at the same position relative to the vertical direction V on tub 124 or within cabinet 102.

In certain embodiments, recirculation line 210 is held within cabinet 102. Additionally or alternatively, recirculation line 210 may extend over the tub 124. Specifically, recirculation line 210 may extend over the tub 124 between the first line end 218 and the second line end 220. For instance, along the length of recirculation line 210, recirculation line 210 may reach upward from first line end 218 (e.g., with air inlet line 230) toward drawer 152 (e.g., while remaining enclosed within cabinet 102) before returning (e.g., with air outlet line 232) leveling out or descending downward to second line end 220.

As noted above, compartment 212 may be disposed along recirculation line 210. Specifically, compartment 212 may be placed (e.g., selectively placed) along the air path 216 between first line end 218 and a second line end 220. To this end, compartment 212 may be selectively disposed in fluid communication with air path 216. For instance, at least a portion of the air path 216 for recirculation line 210 may be joined or partially defined by the compartment 212. At least a portion of the air flowing through recirculation line 210 may, thus, be forced to pass through the compartment 212 (e.g., before returning to the tub 124). During or prior to use, a user may supply one or more additives (e.g., scent pellets 214) to infuse with or affect air flowing through compartment 212 (e.g., and recirculation line 210 prior to being returned to tub 124). In certain embodiments, an airflow can be motivated through recirculation line 210, which itself may be free of any dedicated fan or blower, by the rotation of wash basket 120 within wash tub 124. Advantageously, the additives may infuse the air without fully dissolving in water. Moreover, the infusion and airflow may notably occur without requiring a separate or dedicated fan or blower. Additionally or alternatively, the infusion and airflow may occur throughout a washing operation or even after a final rinse (e.g., in conjunction with rotation of the wash basket 120), advantageously ensuring the additive remains on the articles following expiration of the wash cycle.

In some embodiments, compartment 212 is held above tub 124. For instance, compartment 212 may be at a height above top end 170 of tub 124. In additional or alternative embodiments, compartment 212 is defined by additive drawer 152. Additive drawer 152 itself may be movably (e.g., slidably) mounted to cabinet 102. In the illustrated embodiments, additive drawer 152 is slidably mounted to front panel 130 to move (e.g., along the transverse direction T) through a hole defined by front panel 130. Optionally, an assembly box 236 is fixed within cabinet 102 to selectively receive additive drawer 152.

Turning especially to FIGS. 6 through 10, various views are provided of additive drawer 152 apart from cabinet 102. As shown, additive drawer 152 generally includes a drawer body that defines compartment 212 within which scent additives (e.g., pellets 214) may be held.

In some embodiments, a first drawer aperture 240 is defined through drawer body (e.g., through a bottom wall or sidewall thereof) upstream from compartment 212 and downstream from air inlet line 230. When assembled, air inlet line 230 may extend to (e.g., in connection with) first drawer aperture 240. Thus, air inlet line 230 may extend from compartment 212 (e.g., to tub 124) in downstream fluid communication with wash chamber 126 to direct air thereto. Moreover, one end of air inlet line 230 may disposed on tub 124 (e.g., at first line end 218 or otherwise about aperture 222—FIG. 4) while the opposite end of air inlet line 230 is disposed on additive drawer 152 (e.g., at or otherwise about first drawer aperture 240).

In optional embodiments, air inlet line 230 includes a discrete first inlet segment 242 and second inlet segment 244 that are selectively joined together (e.g., along air path 216). Generally, the first and second inlet segments 242, 244 may be fixed to (e.g., directly or indirectly) to separate elements and are, thus, permitted to move relative to each other. In certain embodiments, first inlet segment 242 is fixed to (e.g., fixedly attached or formed with) additive drawer 152 while second inlet segment 244 is fixed to (e.g., fixedly attached or formed with) tub 124 (e.g., to assembly box 236). Thus, as additive drawer 152 slides forward-rearward relative to cabinet 102, first inlet segment 242 may similarly or simultaneously slide while second inlet segment 244 remains static within cabinet 102. Moreover, when additive drawer 152 is moved forward to an extended position (e.g., such that at least a portion of additive drawer 152 is opened or otherwise allows a user to access the compartments thereof), first and second inlet segments 242, 244 may be separated or spaced apart from each other, such that the inlet segments are no longer in fluid communication (i.e., in fluid isolation) with each other. By contrast, when additive drawer 152 is moved rearward to a contracted position (e.g., such additive drawer 152 is closed, preventing user access to compartments thereof), first and second inlet segments 242, 244 may be joined together in fluid communication, thereby connecting air inlet line 230 and completing at least a portion of air path 216. For instance, a male tip 246 or section of first inlet segment 242 may be received within a female section 248 of second inlet segment 244. Optionally, the male tip 246 and female section 248 both extend or are directed along the transverse direction T, or otherwise parallel to the direction of movement for the additive drawer 152. In certain embodiments, one or more O-rings are disposed on first or second inlet segment 242 or 244, thereby helping to seal air inlet line 230 with compartment.

In additional or alternative embodiments, a second drawer aperture 250 is defined through drawer body (e.g., through a bottom wall or sidewall thereof) upstream from compartment 212 and downstream from air outlet line 232. When assembled, air outlet line 232 may extend to (e.g., in connection with) second drawer aperture 250. Thus, air outlet line 232 may extend from compartment 212 (e.g., to tub 124) in downstream fluid communication with wash chamber to direct air thereto. Moreover, one end of air outlet line 232 may disposed on tub 124 (e.g., at second line end 220 or otherwise about aperture 224—FIG. 4) while the opposite end of air outlet line 232 is disposed on additive drawer 152 (e.g., at or otherwise about second drawer aperture 250).

In optional embodiments, air outlet line 232 includes a discrete first outlet segment 252 and second outlet segment 254 that are selectively joined together (e.g., along air path 216). Generally, the first and second outlet segments 252, 254 may be fixed to (e.g., directly or indirectly) to separate elements and are, thus, permitted to move relative to each other. In certain embodiments, first outlet segment 252 is fixed to (e.g., fixedly attached or formed with) additive drawer 152 while second outlet segment 254 is fixed to (e.g., fixedly attached or formed with) tub 124 (e.g., to assembly box 236). Thus, as additive drawer 152 slides forward-rearward relative to cabinet 102, first outlet segment 252 may similarly or simultaneously slide while second outlet segment 254 remains static within cabinet 102. Moreover, when additive drawer 152 is moved forward to an extended position (e.g., such that at least a portion of additive drawer 152 is opened or otherwise allows a user to access the compartments thereof), first and second outlet segments 252, 254 may be separated or spaced apart from each other, such that the outlet segments are no longer in fluid communication (i.e., in fluid isolation) with each other. By contrast, when additive drawer 152 is moved rearward to a contracted position (e.g., such additive drawer 152 is closed, preventing user access to compartments thereof), first and second outlet segments 252, 254 may be joined together in fluid communication, thereby connecting air outlet line 232 and completing at least a portion of air path 216. For instance, a male tip 256 or section of first outlet segment 252 may be received within a female section 258 of second outlet segment 254. Optionally, the male tip 256 and female section 258 both extend or are directed along the transverse direction T, or otherwise parallel to the direction of movement for the additive drawer 152. In certain embodiments, one or more O-rings are disposed on first or second outlet segment 252 or 254, thereby helping to seal air outlet line 232 with compartment.

As shown, in addition to compartment 212, additive drawer 152 may define one or more other additive compartments to receive separate additives therein. Such additional compartments may be spaced apart from compartment 212 by one or more internal walls. As an example, additive drawer 152 may further define a liquid compartment 260 (e.g., adjacent to compartment 212). An internal partition wall 262 within additive drawer 152 may extend between or separate compartment 212 and the liquid compartment 260 to receive a liquid additive (e.g., detergent, fabric softener, etc.) therein. Internal partition wall 262 may extend (e.g., directly) from a bottom surface of additive drawer 152. Thus, internal partition wall 262 may prevent the liquid additive within liquid compartment 260 from flowing into compartment 212. Optionally, partition wall 262 may define an inter-compartment passage 264 extending (e.g., horizontally) therethrough from the compartment 212 to the liquid compartment 260. For instance, inter-compartment passage 264 may be formed as a descending notch along an upper edge of partition wall 262. Notably, vapors from liquid compartment 260 may be permitted to pass to compartment 212 (e.g., when additive drawer 152 is closed or in the contracted position) while still holding a liquid additive outside of compartment 212. Notably, water vapor or vaporized portions of liquid additives within liquid compartment 260 may be permitted to compartment 212, facilitating infusion without permitting liquid additives thereto.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet defining an opening to receive articles therethrough;

a tub positioned within the cabinet;

a wash basket rotatably mounted within the tub, the wash basket defining a wash chamber for receiving articles for washing;

a drawer mounted to the cabinet, the drawer defining a compartment to receive a scent additive therein;

an air inlet line extending from the compartment in downstream fluid communication with the wash chamber to direct air therefrom; and an air outlet line extending to the compartment in upstream fluid communication with the wash chamber to direct air thereto, wherein the air outlet line extends between the compartment and the tub apart from the air inlet line.

2. The washing machine appliance of claim 1, wherein the air inlet line extends through the tub.

3. The washing machine appliance of claim 1, further comprising a resilient baffle extending from the opening to the tub, wherein the air outlet line extends through the resilient baffle.

4. The washing machine appliance of claim 1, wherein the drawer is slidably mounted to the cabinet.

5. The washing machine appliance of claim 1, wherein the air inlet line comprises a first inlet segment and a second inlet segment selectively joined to the first inlet segment, wherein the first inlet segment is fixed to the drawer to move therewith, and wherein the second inlet segment is fixed relative to the tub within the cabinet.

6. The washing machine appliance of claim 5, wherein the air outlet line comprises a first outlet segment and a second outlet segment selectively joined to the first outlet segment, wherein the first outlet segment is fixed to the drawer to move therewith, and wherein the second outlet segment is fixed relative to the tub within the cabinet.

7. The washing machine appliance of claim 1, wherein the compartment is a first compartment, wherein the drawer further defines a liquid compartment to receive a liquid additive therein, and wherein the drawer further comprises a partition wall extending between the first compartment and the liquid compartment to separate the first compartment and the liquid compartment.

8. The washing machine appliance of claim 7, wherein the partition wall defines an inter-compartment passage extending horizontally therethrough from the first compartment to the liquid compartment.

9. The washing machine appliance of claim 1, wherein the tub defines a centerline between a top end and a bottom end, and wherein the air inlet line and the air outlet line are held above the centerline.

10. A washing machine appliance comprising:

a cabinet comprising a front panel, the front panel defining an opening to receive articles therethrough;

a tub positioned within the cabinet;

a wash basket rotatably mounted within the tub, the wash basket defining a wash chamber for receiving articles for washing;

a drawer movably mounted to the cabinet, the drawer defining a first compartment to receive a scent additive therein and a liquid compartment to receive a liquid additive therein, the liquid compartment being horizontally spaced apart from the first compartment;

an air inlet line extending from the first compartment in upstream fluid communication with the wash chamber to direct air thereto; and an air outlet line extending to the first compartment in downstream fluid communication with the wash chamber to direct air therefrom, wherein the air outlet line extends between the compartment and the tub apart from the air inlet line.

11. The washing machine appliance of claim 10, wherein the air inlet line extends through the tub.

12. The washing machine appliance of claim 10, further comprising a resilient baffle extending from the opening to the tub, wherein the air outlet line extends through the resilient baffle.

13. The washing machine appliance of claim 10, wherein the drawer is slidably mounted to the cabinet.

14. The washing machine appliance of claim 10, wherein the air inlet line comprises a first inlet segment and a second inlet segment selectively joined to the first inlet segment, wherein the first inlet segment is fixed to the drawer to move therewith, and wherein the second inlet segment is fixed relative to the tub within the cabinet.

15. The washing machine appliance of claim 14, wherein the air outlet line comprises a first outlet segment and a second outlet segment selectively joined to the first outlet segment, wherein the first outlet segment is fixed to the drawer to move therewith, and wherein the second outlet segment is fixed relative to the tub within the cabinet.

16. The washing machine appliance of claim 10, wherein the drawer further comprises a partition wall extending between the first compartment and the liquid compartment to separate the first compartment and the liquid compartment.

17. The washing machine appliance of claim 16, wherein the partition wall defines an inter-compartment passage extending horizontally therethrough from the first compartment to the liquid compartment.

18. The washing machine appliance of claim 10, wherein the tub defines a centerline between a top end and a bottom end, and wherein the air inlet line and the air outlet line are held above the centerline.

19. A washing machine appliance comprising:

a cabinet defining an opening to receive articles therethrough;

a tub positioned within the cabinet;

a wash basket rotatably mounted within the tub, the wash basket defining a wash chamber for receiving articles for washing;

a drawer mounted to the cabinet, the drawer defining a compartment to receive a scent additive therein;

an air inlet line extending from the compartment in downstream fluid communication with the wash chamber to direct air therefrom; and an air outlet line extending to the compartment in upstream fluid communication with the wash chamber to direct air thereto, wherein the drawer is slidably mounted to the cabinet, wherein the air inlet line comprises a first inlet segment and a second inlet segment selectively joined to the first inlet segment, wherein the first inlet segment is fixed to the drawer to slide therewith, wherein the second inlet segment is fixed relative to the tub within the cabinet, wherein the air outlet line comprises a first outlet segment and a second outlet segment selectively joined to the first outlet segment, wherein the first outlet segment is fixed to the drawer to move therewith, and wherein the second outlet segment is fixed relative to the tub within the cabinet.

20. The washing machine appliance of claim 19, wherein the compartment is a first compartment, wherein the drawer further defines a liquid compartment to receive a liquid additive therein, wherein the drawer further comprises a partition wall extending between the first compartment and the liquid compartment to separate the first compartment and the liquid compartment, and wherein the partition wall defines an inter-compartment passage extending horizontally therethrough from the first compartment to the liquid compartment.

* * * * *